United States Patent [19]

Minami

[11] 4,382,597

[45] May 10, 1983

[54] PINBALL GAME EMPLOYING LIQUID

[75] Inventor: Koichi Minami, Tokyo, Japan

[73] Assignee: Tomy Kogyo Co., Inc., Tokyo, Japan

[21] Appl. No.: 187,567

[22] Filed: Sep. 15, 1980

Related U.S. Application Data

[63] Continuation-in-part of Ser. No. 171,661, Jul. 24, 1980, Pat. No. 4,363,483.

[30] Foreign Application Priority Data

Nov. 13, 1979 [JP] Japan ..... 54-146845

[51] Int. Cl.[3] ..... A63F 7/00

[52] U.S. Cl. ..... 273/1 L

[58] Field of Search ..... 273/1 L, 121, 119, 85 H, 273/394, 396, 397

[56] References Cited

U.S. PATENT DOCUMENTS

| | | | |
|---|---|---|---|
| 2,827,034 | 3/1958 | Rothe | 273/397 X |
| 3,383,111 | 5/1968 | Lucas | 273/121 A |
| 3,741,541 | 6/1973 | Crismani | 273/85 H |
| 4,032,141 | 6/1977 | Tanimura | 273/1 L |
| 4,054,287 | 10/1977 | Goldfarb et al. | 273/119 R X |
| 4,136,872 | 1/1979 | Matsumoto | 273/1 L X |
| 4,142,715 | 3/1979 | Matsumoto | 273/1 L |
| 4,162,793 | 7/1979 | Cummings | 273/121 A |
| 4,199,143 | 4/1980 | Dieckhaus | 273/121 A |
| 4,223,471 | 9/1980 | Greenberg | 273/1 L X |
| 4,226,423 | 10/1980 | Nix et al. | 273/397 |
| 4,269,413 | 5/1981 | Langieri | 273/121 R |

FOREIGN PATENT DOCUMENTS

| | | | |
|---|---|---|---|
| 7810160 | 4/1979 | Netherlands | 273/1 L |
| 143966 | 6/1920 | United Kingdom | 273/85 H |
| 272624 | 6/1927 | United Kingdom | 273/85 H |

OTHER PUBLICATIONS

Tomy 1976 Catalog, p. 18, 2-1976.

*Primary Examiner*—Paul E. Shapiro

*Attorney, Agent, or Firm*—K. H. Boswell; Edward D. O'Brian

[57] ABSTRACT

A pinball game is contained within a housing which includes a liquid filled chamber. At least one ball is located within the liquid within the chamber. The ball has a specific gravity heavier than the liquid such that it tends to sink within the liquid but it is light enough to be conveyed upwardly by currents within the liquid. A flipper is located within the chamber and is capable of interacting with the ball to propel it within the confines of the chamber. The flipper is controlled by an actuator member located on the housing and operatively connected to the flipper to move the flipper. At least one goal receptacle is positioned within the chamber and the ball is capable of being located or deposited in the goal receptacle. It is the object to deposit the ball in the goal receptacle by manipulating the ball with the flippers and/or currents of liquid.

3 Claims, 10 Drawing Figures

10
20
42
40
152
148
152
150
150
36
86
18
82
34
170
164
88
30
112
170
166
168
170
36
60
78
80
90
66
68
66
84
62
92
36
36
56
134
126
16
14
12
22
96
94
32
62
118
24
26
108
38
28
44

PINBALL GAME EMPLOYING LIQUID

CROSS-REFERENCE TO RELATED APPLICATIONS

This application is a continuation-in-part of my application entitled "Competitive Water Filled Game," Ser. No. 171,661, filed July 24, 1980, now U.S. Pat. No. 4,363,483 the entire disclosure of which is herein incorporated by reference.

BACKGROUND OF THE INVENTION

This invention is directed to a pinball game which utilizes a chamber filled with a liquid medium. The game includes at least one ball which is manipulated through the liquid by means of flippers toward a goal receptacle.

A series of games manufactured by the assignee of this invention are directed to movement of an object within a body of liquid which is contained within a housing. These games are known under the registered trademark "WATERFULS." In my application entitled "Competitive Water Filled Game" I describe a game which is capable of being used in a competitive manner between two persons. This game is based on the above described effect of moving an object within a body of liquid. In my application entitled "Competitive Water Filled Game" each player has under his control a nozzle which is capable of ejecting liquid and circulating the same within the housing. It is an object of that game for each player to move a ball into the goal controlled by the other player.

Pinball type games have maintained the interest of generations of players. Recently with advances in electronics, pinball games have taken on a new era of sophistication. Aside from the typical strictly mechanical type pinball games there are presently available pinball related games which because of their electronic components are capable of doing an amazing variety of operations which are very interesting and stimulating to the players.

The majority of known pinball games utilize a horizontal or near horizontal playing surface. There is one noted exception to this and that is the Japanese Pachinko type game. All of these pinball games however move metal balls through the air.

There are no known pinball games wherein variety is given to the game by substituting a fluid other than air within the housing. It is considered that such a substitution would totally change the interest level of the game in that no longer would the balls of the pinball game be simply free to move with almost negligible fluid friction from the flippers or the bumpers toward the receptacles. The above noted "WATERFUL" games while being based on a variety of different concepts do not utilize the pinball type concept. It is considered that a "WATERFUL" type game which operates in certain respects like a pinball game would be very fascinating to play and thus find great utility in the amusement field.

SUMMARY OF THE INVENTION

It is an object of this invention to provide a game which can be played like a pinball game but which utilizes a fluid other than air within the housing of the game. It is a further object to provide a game wherein the density of both a movable object and a suspending fluid are chosen such that the movable object can descend through the fluid under gravity but is capable of being propelled through the fluid either by a mechanical member or by currents within the fluid. It is a further object to provide a game which because of its simplicity of construction is essentially troublefree, economical to manufacture, and easily played by a spectrum of age groups.

These and other objects are achieved in a pinball game which comprises: a housing, said housing having a chamber, said chamber capable of containing a quantity of a fluid, said fluid having a specific gravity greater than the specific gravity of air; at least one ball located within said chamber, said ball having a specific gravity greater than the specific gravity of said fluid and related to the specific gravity of the fluid such that it is capable of being conveyed within the fluid by currents within the fluid; at least one flipper located within said chamber such that it is capable of interacting with said ball within said chamber; at least one flipper actuator means located on said housing and operatively connected to said flipper such that said flipper can be caused to move from a first position to a second position in response to activation by said flipper actuator means; a goal receptacle positioned within said chamber, said ball capable of being located in said goal receptacle; said flipper capable of interacting with said ball to propel said ball within said chamber and said ball capable of being located within said receptacle if the path of travel of said ball within said chamber locates said ball in association with said receptacle.

Further, these objects are achieved in a game having a transparent housing, a liquid located within said housing, a movable member having a specific gravity greater than the specific gravity of said liquid, said movable member located within said housing in said liquid, two circulating means for circulating said liquid within said housing, each of said circulating means capable of being independently operated such that each is capable of removing liquid from the interior of said housing and ejecting a stream of said liquid into the interior of said housing at a variable rate, each of said circulating means having a nozzle directed into the interior of said housing for ejecting said stream of liquid into the interior of said housing the improvement which comprises: said nozzles located separately within the interior of said housing and spaced apart from one another such that said stream of liquid ejected from each of said nozzles will at least each initially move independently from the stream of liquid ejected from the other of said nozzles; two pivoting members each independently pivotally mounted within the interior of said housing in said liquid and each capable of moving with respect to said housing, one of said pivoting members operatively associated with the nozzle of one of said circulating means and the other of said pivoting members operatively associated with the nozzle of the other of said circulating means, each of said pivoting members independently being capable of being pivoted with respect to said housing in response to impingement upon at least a portion of each of said pivoting members by a portion of said stream of liquid ejected from its associated nozzle; a portion of said stream of liquid ejected from each of said nozzles capable of moving past the pivoting member associated with said nozzles from which said stream of liquid is ejected without impinging upon said pivoting member to cause currents to flow within the body of liquid located within said housing; each of said pivoting members capable of independently causing movement of said movable member within said housing when said movable member is positioned adjacent to said pivoting member such that it can be contacted by said pivoting member as said pivoting member pivots.

The movable member or ball is directed toward the goal receptacle by the pivoting members or flippers. The goal receptacle preferably includes an inlet opening and an outlet opening. The outlet opening preferably is equipped with a closure means capable of reversibly sealing it such that it is capable of retaining the ball or movable member within the confines of the goal receptacle and then releasing the same.

Preferably the inside of the housing includes a vertically oriented chamber allowing the movable member or ball to move upwardly or downwardly within the chamber.

BRIEF DESCRIPTION OF THE DRAWINGS

This invention will be better understood when taken in conjunction with the drawings wherein:

FIG. 3 and FIG. 4 are shown in these two figures in a different orientation with respect to one another;

Figure 1:
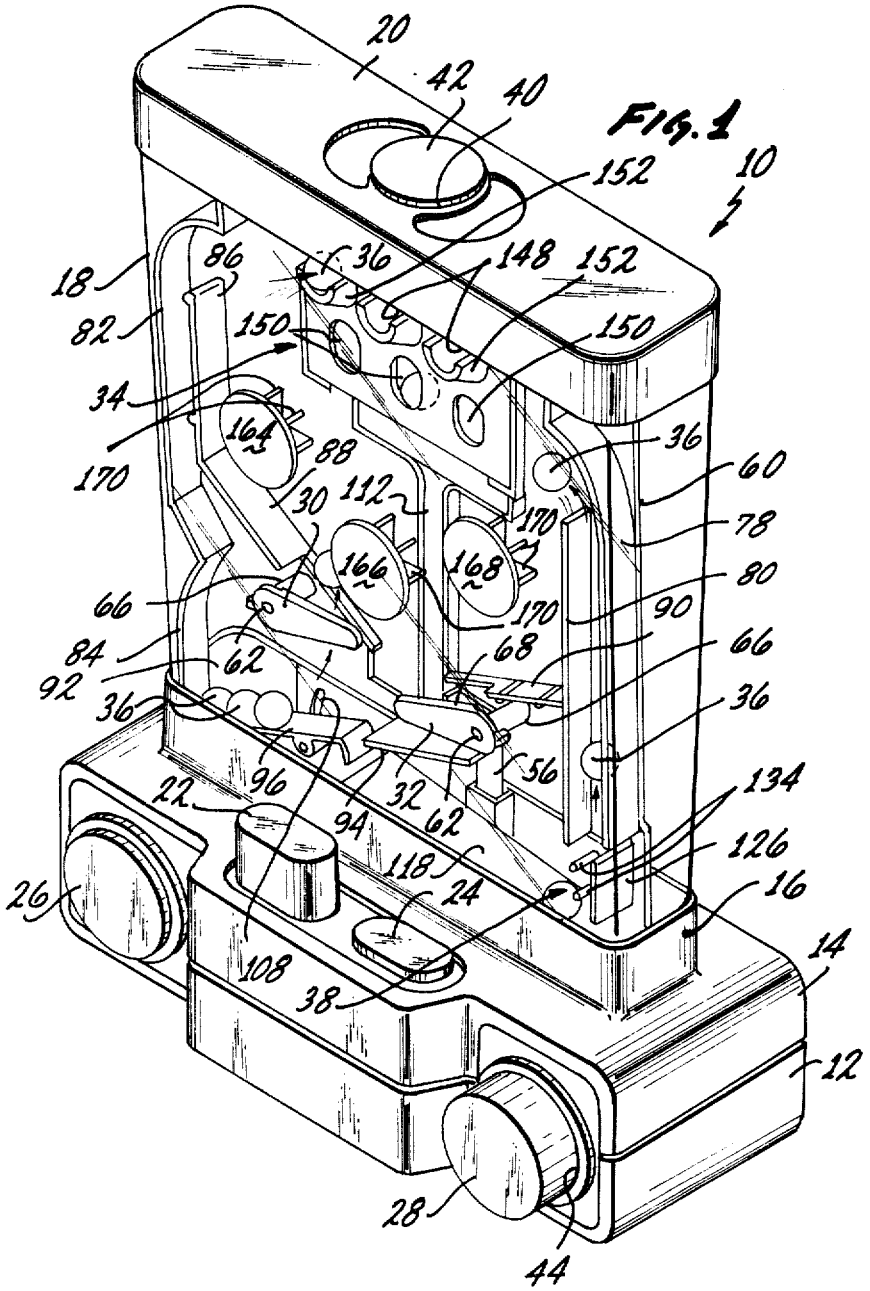
FIG. 1 is an isometric view of the game of the invention.

This invention encompasses certain principles and/or concepts as are set forth and claimed in the claims appended to this specification. Those skilled in the toy arts will realize that these principles and/or concepts can be applied to a number of differently appearing embodiments without departing from the scope of the claims and are not necessarily limited to the illustrated embodiments. For this reason this invention is to be construed as being limited only by the scope of the claims and is not to be construed as being limited to the exact embodiments herein depicted.

DETAILED DESCRIPTION

The game 10 of the invention could be considered as a pinball game insofar as it incorporates certain features normally associated with pinball games. These features include the use of balls which are manipulated by flippers toward receptacles.

The game 10 has a lower base member 12 which mates with an upper base member 14. Together these two members 12 and 14 form a base (not separately numbered). Extending around the top of upper base member 14 is a collar 16. The collar 16 is integrally formed with the upper base member 14. A transparent, hollow enclosure 18 fits within the collar 16 and extends upward from it. A cap 20 fits on the top of enclosure 18. Together the base members 12 and 14 and the enclosure 18 and cap 20 form the housing (not separately numbered) of the game 10.

Located on upper base member 14 are reset button 22 and shoot button 24. Extending outwardly from the front of the base of game 10 are left and right flipper control buttons 26 and 28, respectively. The flipper control buttons 26 and 28 control the left and right flippers 30 and 32, respectively, as hereinafter explained. A goal receptacle 34 is located within enclosure 18 near cap 20. A plurality of balls or movable members 36 are also located in the enclosure 18. On the right-hand side of enclosure 18 is the ball launch mechanism 38 hereinafter more fully explained.

The game operates generally as follows: A body of fluid, preferably a liquid, preferably water, is located within the chamber (not separately numbered) formed by enclosure 18. For the preferred embodiment the plurality of balls 36 are placed within fluid, i.e., the water. One ball 36 at a time is launched by the ball launcher mechanism 38 into the body of the water. This is accomplished by depressing the shoot button 24. Once the ball 36 is in the main body of the water it descends downwardly under the influence of gravity. The right and left flippers 32 and 30 are manipulated via the right and left flipper control buttons 28 and 26 to strike the ball 36 and lift it upwardly within the body of the liquid. Further, as is more fully hereinafter explained, this also causes currents to be generated within the liquid. In any event attempts are made to deposit each one of the balls 36 into the goal receptacle 34. When this has been accomplished or when all of the balls 36 are either in the goal receptacle 34 or are out of play as more fully described below, the game is over and the player must then push the reset button 22 to again position the balls 36 wherein they can be acted on by the ball launch mechanism 38.

The interior of the enclosure 18 is filled in the preferred embodiment with water by introducing it through an opening 40 located in cap 20 which is sealable with a bung 42. The inside of enclosure 18 is filled with sufficient liquid to completely fill the vertically oriented chamber up to the cap 20 thus completely covering everything inside of the enclosure 18 including the goal receptacle 34 which is the uppermost component within the enclosure 18.

The balls 36 are made out of a material such that their specific gravity is greater than the specific gravity of the fluid introduced within the enclosure 18. For the preferred embodiment the balls 36 are simply plastic spheres which have a density slightly greater than that of water. This allows them to descend under the influence of gravity downwardly within the enclosure 18. Further, their specific gravity is such that they are still able to be conveyed upwardly within the fluid by currents flowing within the fluid or by momentum imparted to them by the mechanical flippers 30 and 32. If other fluids other than water were used the specific gravity of the material of which the balls 36 are formed would be chosen such that the balls 36 would have a specific gravity slightly greater than that of the suspending fluid but not so great that it would be impossible for currents of this fluid to lift the balls 36.

The bottom (not separately numbered) of the enclosure 18 is sealed with the walls (not separately numbered) of the enclosure 18 making a fluid-tight container. Four holes (not numbered or identified) are located within the bottom of enclosure 18. Attaching to each one of these holes either directly or indirectly via tubes as more fully explained hereinafter are one of four bellows members not identified at this time. There is a fluid-tight seal between the bellows or any conducting tubes attaching thereto where appropriate, and the enclosure 18. This allows the bellows to be filled from and to eject fluid into the enclosure 18 upon contraction and expansion of the bellows or for movement of members within enclosure 18 while maintaining a tight fluid seal.

Figure 7:
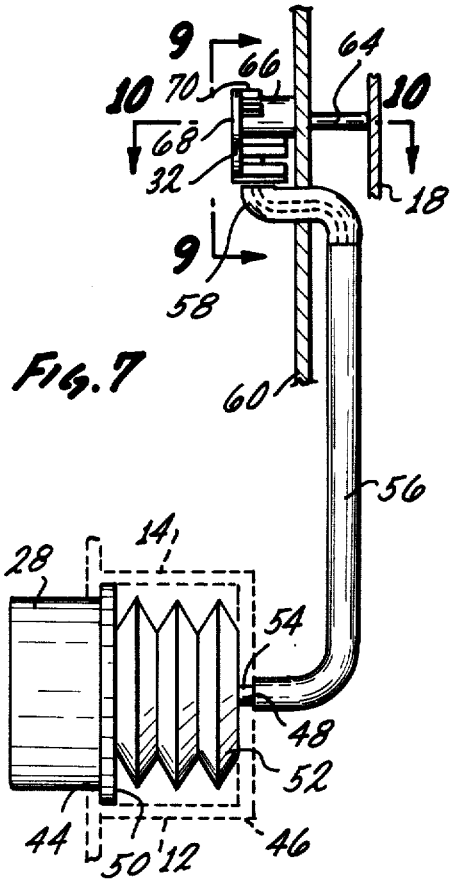
FIG. 7 and FIG. 8 are side elevational views in partial section of certain of the components located near the center of and on the lower right hand side of FIG. 1.
Figure 8:
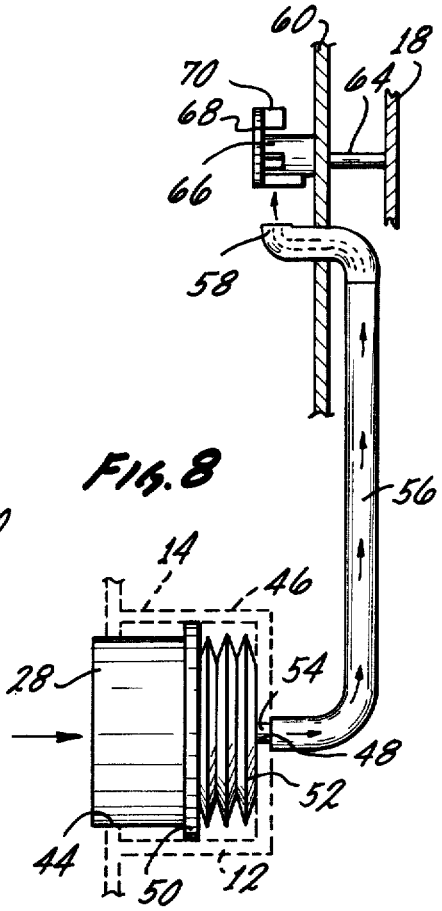

In FIGS. 7 and 8 the right flipper control button 28 and the right flipper 32 are shown as well as other components associated with these. In operation and structure the left flipper 30 and its control button 26 are identical to the right flipper 32 and its control button 28 and thus need not be separately described. Because of this like numerals are used in the drawings with respect to identical parts associated with both the right and left flippers 32 and 30. The right flipper control button 28 projects through opening 44 which is formed in both the upper and lower base members 12 and 14. Extending behind opening 44 is a U shaped bracket 46. Bracket 46 is, in reality, a composite bracket having a component (not separately numbered) which is integrally formed with both the lower base member 12 and an identical component formed with the upper base member 14. They meet at a seamline (not shown) in the back center of the button 28 wherein an opening 48 is formed. Button 28 has a flange 50 on its back surface which serves to maintain the button 28 within the opening 44 and 46. Bellows 52 is placed within the hollow interior of button 28 and is fixedly located between button 28 and bracket 46. A nipple 54 formed on one end of bellows 52 passes through opening 48. The bellows 52 is imperforate except for the opening in the nipple 54.

A tube 56 leads from nipple 54 through the bottom of the enclosure 18 and upward a short distance within the body of the enclosure 18. The tube 56 is sealed to the enclosure 18 thus forming a fluid-tight connection between bellows 52 and enclosure 18. The uppermost portion of the tube 56 is bent in an S shape and includes a nozzle 58 as its upper extemity. The nozzle 58 is located within the body of the fluid in the enclosure 18. Depression of the button 28 compresses the bellows 52 forcing fluid within the bellows 52 out through the tube 56 and nozzle 58. On release of the button 28 a natural expansion action within bellows 52 causes it to expand which sucks or draws fluid from the enclosure 18 through the nozzle 58 and the tube 56. The bellows 52 is made of a semiresilient material such as polyethylene. It is molded in an expanded shape and when compressed tends to return to its expanded shape under its own bias.

A vertically oriented plate 60 is placed within the enclosure 18. Plate 60 essentially divides enclosure 18 in half vertically such that there is an area in front of the plate 60 wherein play of the game takes place and an area behind the plate 60 wherein certain components as hereinafter explained are free to move uninhibited by the presence of the balls 36. As is seen in FIGS. 7 and 8 the tube 56 extends upward within the enclosure 18 initially behind the plate 60 and thus out of the way and only extends into the front or playing area of the enclosure 18 when it makes its S shaped bend.

The two flippers 30 and 32 are identical except that they are mirror images of each other. For this reason the mechanical operation of only one need be explained. Right flipper 32 is rotatably mounted about an axle 62 which is integrally formed with the plate 60 and extends horizontally through the plate 60. The rearward portion 64 of axle 62 serves to help position the plate 60 within the enclosure 18. As is seen in FIG. 8 it abuts against the surface of enclosure 18. The other side of the axle 62 extends into the playing area, i.e., the front area of enclosure 18. Flipper 32 has a hollow bearing 66 formed on it which fits over the axle 62.

Figure 10:
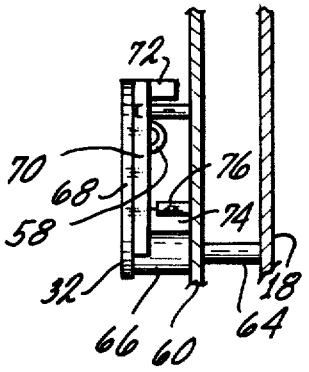
FIG. 10 is a plan view in partial section about the line 10—10 of FIG. 7.

The fit between the bearing 66 and the axle 62 is such that the bearing 66 is free to rotate about axle 62. The arm portion 68 of the flipper 32 extends toward the center of the enclosure 18. On the upper surface of the arm 68 is a flange 70 which extends part way toward the plate 60 as can best be seen in FIG. 10. The nozzle 58 is located below the arm 68 and spaced toward the plate 60.

Figure 9:
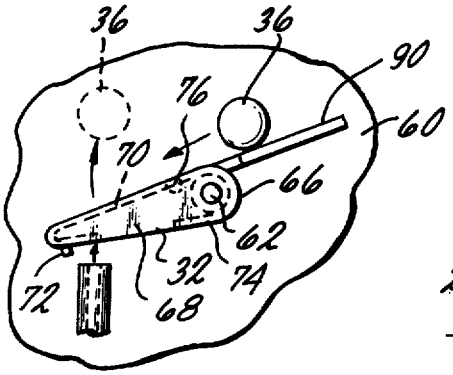
FIG. 9 is a front elevational view about the line 9—9 of FIG. 7.

When fluid is ejected from the nozzle 58 it goes upwardly past the arm 68 and a certain portion of it impinges on the flange 70 causng the flipper 32 to rotate about axle 62. The majority of the fluid, however, freely passes by the flipper 32 and thus creates a current in the fluid over it. Sufficient momentum is imparted to the flipper 32 by the movement of the fluid past it to cause it to rotate and to enable it to propel a ball 36 if in fact a ball 36 is located on it such as is depicted in FIG. 9. On the end of the arm 68 is a tab of material 72 which counterweights this end downwardly after rotation of the flipper 32 by the fluid moving past it. The tab 72 thus serves as a gravity biasing means to maintain the flipper in a ready position. A second tab 74 located near bearing 66 is positioned to interact with peg 76 extending from plate 60. The interaction of the tab 74 with peg 76 limits the upward travel of the flipper 32 and thus serves to define a second position for the flipper 32.

Referring to FIG. 1 there are a series of baffles (identified below) which extend outwardly from plate 60 toward the front of the enclosure 18. These serve to define pathways within the enclosure 18. Additionally the front edge of these baffles rests against the front surface of enclosure 18 and thus together with rearward projection members such as rear portion 64 of axle 62, hold plate 60 in position within the center (with respect to the fore and aft axes) of the enclosure 18. All of the baffles are stationary with the exception of two as will be described below.

On the right-hand side of the enclosure 18 is curved baffle 78 which together with baffle 80 serves as a launching channel in conjunction with the ball launching mechanism 38. The baffles 78 and 80 are essentially vertically oriented. The curvature on the top of baffle 78 causes the ball 38 to curve to the left into the field of play as the ball 36 travels between the baffles 78 and 80. On the left-hand side of enclosure 18 is baffle 82 which is somewhat complex in shape and has a curve portion on its top essentially similar to baffle 78 and also includes an arcuate shaped area 84 on its lower end which function will be described below. Extending parallel to the vertical portion of baffle 82 is baffle 86.

Extending obliquely from baffle 86 down toward the center of the housing is baffle 88. A similar baffle 90 extends from baffle 80 on the right-hand side of the enclosure 18 toward the center. Both baffles 88 and 90 have cut-out areas (not numbered) which are positioned directly over the flippers 30 and 32. Any ball 36 descending downwardly which strikes either baffle 88 or 90 is therefore channeled directly over one or the other of the flippers 30 or 32. A channel (not numbered) formed between baffles 82 and 86 leads to the out-of-play area 92 located below left flipper 30. The channel (not numbered) between the left and right flippers 30 and 32, i.e., the channel in the very center near the bottom of the enclosure 18, is also an out-of-play area and feeds into area 92. Any ball 36 which descends into either of these areas no longer is capable of being contacted with either the flippers 30 or 32 or currents issuing out of the nozzle 58 and is thus out of play.

Located directly below the channel between the flippers 30 and 32 is movable baffle 94 which can be seen in both FIGS. 1 and 2. Directly in line with movable baffle 94 is a pivoting member 96 which serves as the bottom of the out-of-play area 92 and also as a means to reintroduce the balls 36 to the ball launcher mechanism 38. An axle 98 formed as part of baffle 94 fits within a bearing surface 100 formed on plate 60. A bearing surface 102 formed on member 96 fits over axle 104 projecting from plate 60. The interaction of the bearings 100 and 102 with the axles 98 and 104 is such that the baffle 94 and the member 96 are free to pivot. A boss 106 formed with member 96 fits through an opening 108 formed in plate 60. A similar boss 110 formed on baffle 94 fits through an opening not seen and therefore not numbered also on plate 60. The opening 108 and the unseen opening serve to allow the bosses 106 and 110 to extend behind plate 60.

A composite sliding member 112 is located on the back side of plate 60. It is caused to go upward and downward as hereinafter explained by depressing reset button 22. As can be seen in FIG. 2 the bosses 106 and 110 projecting from member 96 and baffle 94 interact with appropriate slots 114 and 116, respectively, formed in sliding member 112. As sliding member 112 is raised interaction of the bosses 106 and 110 with the slots 114 and 116 tilt the respective member 96 and baffle 94 as is shown in phantom lines in FIG. 2. The arcuate area 84 of baffle 82 allows the left-hand end of the member 96 to always be in close contact with this baffle. Any balls 36 located on the member 96 are thus caused to roll from the left end of member 96 toward the right end of the member 96 in response to member 96 pivoting from the position shown in solid lines in FIG. 2 to the position shown in phantom lines.

Located underneath baffle 94 is an obliquely slanting baffle 118 which leads directly to the ball launching mechanism 38. When the balls 36 are rolled from left to right across member 96 as described in the previous paragraph they roll onto baffle 118 and down it toward the ball launching mechanism 38.

Figure 6:
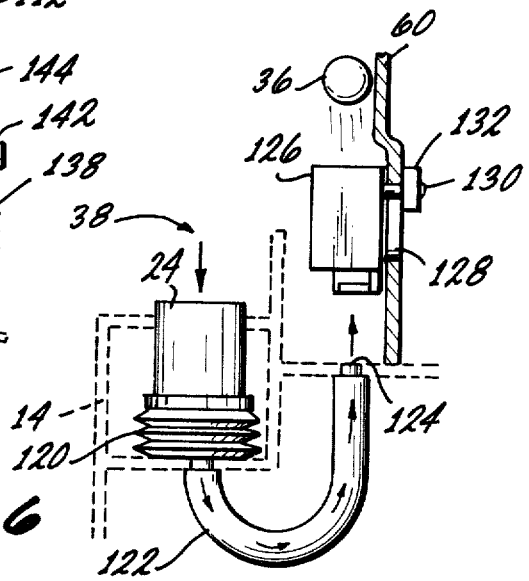

Returning now to the launching mechanism 38, the shoot button 24 is located directly over a bellows 120 in a manner completely analogous to the way button 28 is located in association with bellows 52. A tube 122 leads from bellows 120 to nozzle 124 which is located directly beneath the channel (not numbered) formed by baffles 78 and 80. A launch member 126 fits beneath baffle 78 and is slidably mounted into slot 128 formed in plate 60 by virtue of a boss 130 which projects rearwardly from launch member 126 through the slot 128. A small rubber washer 132 is attached to the end of boss 130 maintaining it within slot 128. Fluid ejected from nozzle 124 in response to depression of shoot button 24 strikes the bottom of launch member 126 lifting it upwardly. If a ball 36 is located within the launch member 126, the upward motion of launch member 126 is communicated to it. The upward motion of the launch member 126 is stopped when as seen in FIG. 6 the boss 130 reaches the upper end of channel 128. A ball 36, however, located within launch member 126 is free to continue traveling upward between the baffles 78 and 80.

Figure 5:
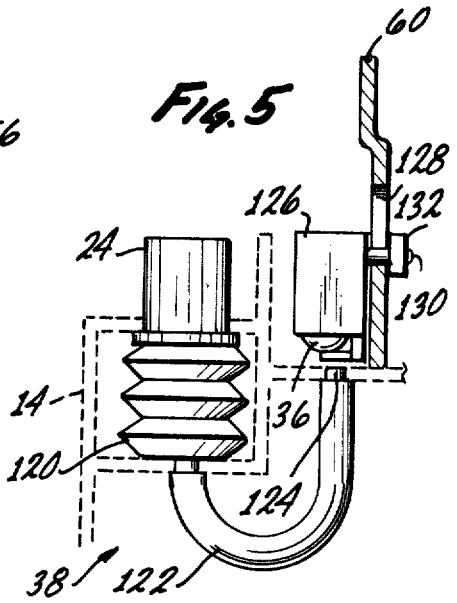
FIG. 5 and FIG. 6 are side elevational views in partial section of certain of the components located in the lower right hand side of FIG. 1.

Positioned below baffle 80 are two pegs collectively identified by the numeral 134. They are formed as part of and project from plate 60. The lowermost of these pegs 134 is spaced upwardly from baffle 118 a sufficient distance to allow one of the balls 36 to roll between it and the baffle 118. This allows one ball 36 at a time to roll onto the launch member 126. When the launch member 126 is raised by the fluid action discussed above, the bottom of it (not separately numbered) soon is aligned with the pegs 134 which inhibits a second ball 36 occupying the launch member 126 when a first ball 36 is already there. A second ball 36 can only roll into the launch member 126 after a first one has been ejected to a position above the launch member 126 and the launcher member 126 again extends to its lowermost position as shown in FIG. 5.

Figures 2, 3:
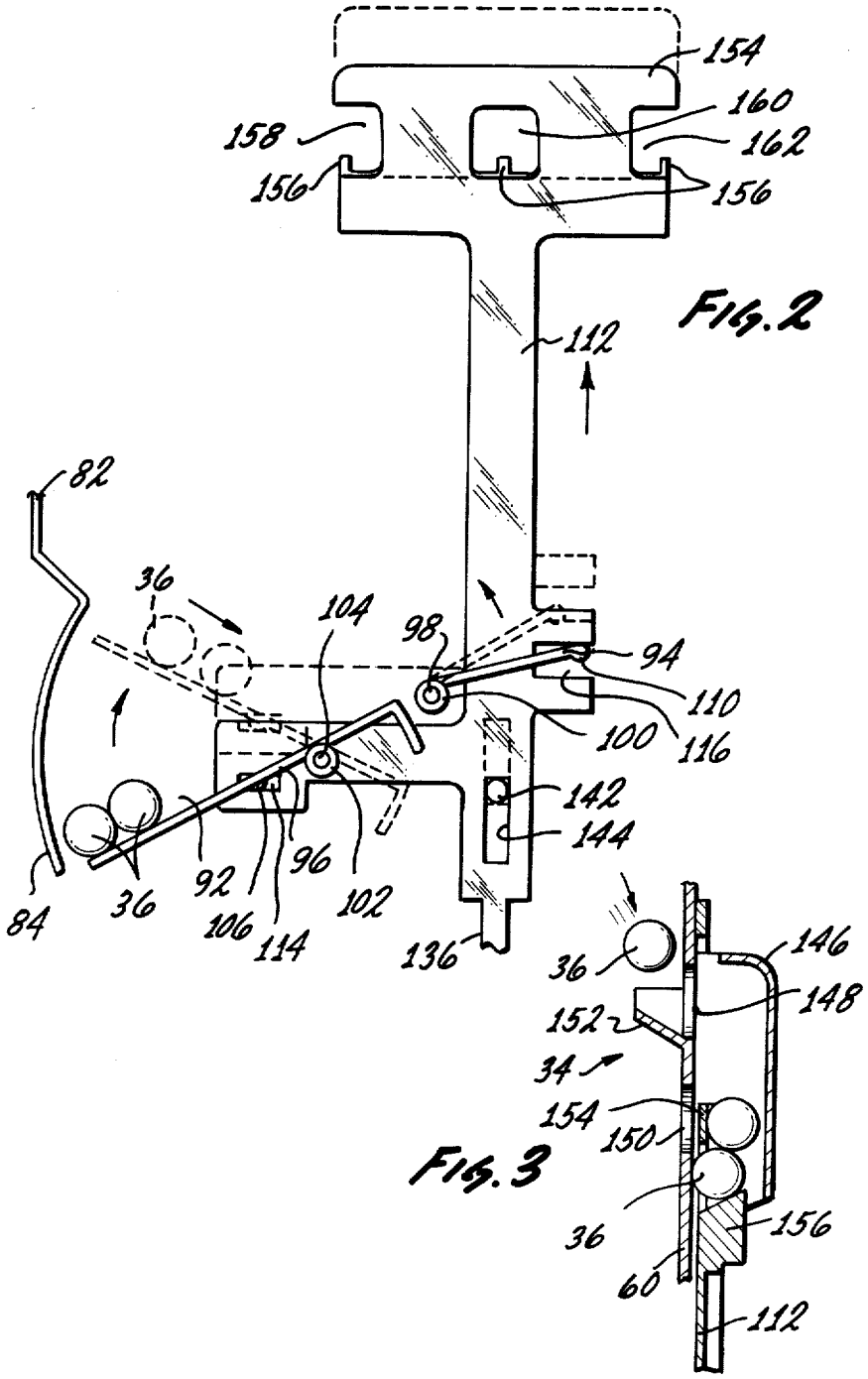
FIG. 2 is an elevational view of certain mechanisms which in part are located internally within the game shown in FIG. 1 and in part exposed near the upper center of FIG. 1.
FIG. 3 is a side elevational view in section of certain components shown in FIG. 2 as well as other components shown in FIG. 1.

If a ball 36 gets out of play by descending between baffles 82 and 86 and coming to rest on the top of member 96 as is shown in solid lines in FIGS. 1 and 2 or if a ball 36 is out of play by passing in between the left and right flippers 30 and 32 and strikes baffle 94, the ball 36 rolls to a rest position on member 96. When member 96 and baffle 94 are in the position shown in solid lines in FIGS. 1 and 2, the combination of the baffle 94 and member 96 forms a solid surface slanting to the left. If baffle 94 and member 96 are tilted to their positions shown in phantom in FIG. 2, the right side of member 96 dips below the left side of baffle 94 allowing all of the balls 36 to roll to the right underneath baffle 94 onto baffle 118.

Figure 4:
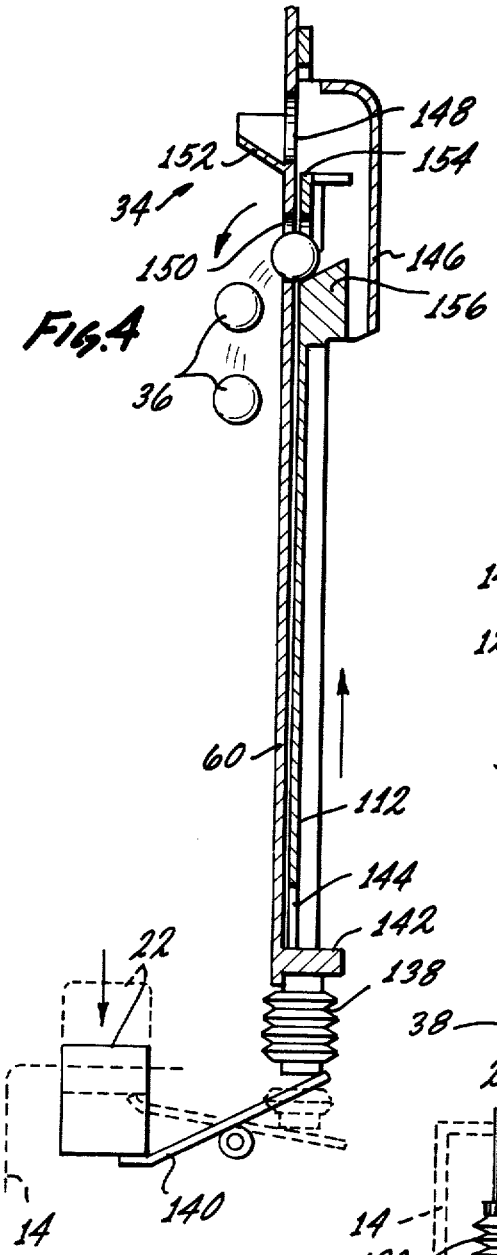
FIG. 4 is a side elevational view of the components shown in FIG. 3 as well as other components; the components shown in both

Sliding member 112 has a small projection 136 on its loweremost end. This projection 136 fits through an appropriate hole (not shown or numbered) at the bottom of enclosure 18. Fitting around this hole and sealing it with respect to fluid containment in enclosure 18 is bellows 138. The projection 136 fits within the interior of the bellows 138. The projection 136 and thus the sliding member 112 can be moved up and down by compressing and releasing the bellows 138. This is accomplished via an appropriate pivoting lever 140 located within upper base member 14. The pivoting lever 140 fits underneath the reset button 22 as seen in FIG. 4 and communicates motion of the reset button 22 to the sliding member 112.

Sliding member 112 is appropriately attached to the back side of plate 60 via a boss 142 which projects from the back side of plate 60 through an elongated slot 144 in sliding member 112. The upper end of sliding member 112 fits within a housing 146 formed on the back side of plate 60. In combination, the housing 146 and the boss 142 and slot 144 retain sliding member 112 against the back side of plate 60 while allowing it to go up and down in response to movement of reset button 22.

The goal receptacle 34 is formed by the combination of the upper portion of sliding member 112, the housing 146, inlet openings collectively identified by the numeral 148, and outlet openings collectively identified by the numeral 150. Inlet and outlet openings 148 and 150 are openings formed in the surface of plate 60. Extending below and outwardly from the inlet opening 148 are arcuately shaped ledges 152. The ledges 152 assist in capturing of the balls 36 and directing them into the inlet opening 148. When a ball 36 is propelled upwardly by either of the flippers 30 or 32 along or in combination with currents being ejected from nozzles 58, the balls 36, if successfully lifted above the ledges 152, can then descend onto the ledges 152 and roll backwardly into the inlet opening 148 to a position behind plate 60.

The top of sliding member 112 is shaped as is shown in FIG. 2. The upper portion 154 of sliding member 112 is positioned to fit against the inside of outlets 150 when sliding member 112 is in its lowermost position as is seen in FIG. 3. Any balls 36 which have successfully passed from ledge 152 into inlet 148 descend within the confines of housing 146 downwardly. They strike wedge-shaped sections 156 of sliding member 112 and are retained thereby. They cannot exit out of outlet holes 150 because of the presence of upper portion 154 of sliding member 112. When play is finished and balls 36 are either maintained within the confines of goal receptacle 34 or in the previously noted out-of-play area 92, reset button 22 is depressed lifting sliding member 112 to the position shown in FIG. 4. In this position the upper portion 154 of sliding member 112 is no longer covering the opening of outlet 150 but in fact openings 158, 160 and 162 formed in sliding member 112 are each positioned directly behind one of outlet openings 150 allowing the wedge-shaped projections 156 to lift the balls 36 upwardly and force them to roll out of outlet openings 150. They then descend downward between the flippers 30 and 32, along the top of baffle 94 and finally onto baffle 118.

Rotatably attached to plate 60 are pinwheels 164, 166 and 168. These pinwheels are attached to appropriate bosses (not seen or numbered) formed on the surface of plate 60. Each of the pinwheels 164, 166 and 168 have a plurality of vanes collectively identified by the numeral 170 which allow them to spin under the influence of currents within the fluid or if struck by a ball 36. Generally when a ball 36 strikes the pinwheels 164, 166 or 168 the ball 36 glances off the pinwheel changing its direction and/or is momentarily reversibly wedged between two adjacent vanes 170 causing the pinwheels to spin before releasing the ball 36 to move off in a different direction.

I claim:

1. A game having a transparent housing, a liquid located within said housing, a movable member having a specific gravity greater than the specific gravity of said liquid, said movable member located within said housing in said liquid, two circulating means for circulating said liquid within said housing, each of said circulating means capable of being independently operated such that each is capable of removing liquid from the interior of said housing and ejecting a stream of said liquid into the interior of said housing at a variable rate, each of said circulating means having a nozzle directed into the interior of said housing for ejecting said stream of liquid into the interior of said housing the improvement which comprises:

said housing being essentially vertically oriented;

said nozzles located separately within the interior of said housing and spaced apart from one another such that said stream of liquid ejected from each of said nozzles will at least each initially move independently from the stream of liquid ejected from the other of said nozzles;

two flippers each independently pivotally mounted within the interior of said housing in said liquid near the bottom of said housing and each capable of moving with respect to said housing, one of said flippers operatively associated with the nozzles of one of said circulating means and the other of said flippers operatively associated with the nozzle of the other of said circulating means, each of said flippers independently being capable of being pivoted with respect to said housing in response to impingement upon at least a portion of said stream of liquid ejected from its associated nozzle;

a portion of said stream of liquid ejected from each of said nozzles capable of moving past the flipper associated with said nozzles from which said stream of liquid is ejected without impinging upon said flipper to cause currents to flow within the body of liquid located within said housing;

each of said flippers capable of independently causing movement of said movable member within said housing when said movable member is positioned adjacent to said flipper such that it can be contacted by said flipper as said flipper pivots;

goal receptacle means located within said housing and surrounded by said liquid so as to be capable of receiving said movable member as said movable member moves through said liquid;

said goal receptacle means comprises a goal receptacle having an inlet opening and an outlet opening and including a closure means associated with said outlet opening to reversibly close said outlet opening allowing retention of said movable member within said goal receptacle and release of said movable member from said goal receptacle through said outlet opening by disassociating said closure means from said outlet opening;

said flippers located below said goal receptacle and said outlet opening of said goal receptacle located below said inlet opening of said goal receptacle;

movable member launcher means located within said housing, at least a portion of said launcher means is located within said liquid;

said movable launcher means capable of causing said movable member to move within said liquid such that it is capable of being acted upon by said flippers and to move said movable member upwardly so that it can enter said goal receptacle;

at least one out-of-play receptacle located in association with the lower extremities of said vertically oriented housing, said movable member capable of being located within said out-of-play receptacle and incapable of being acted upon by said flippers when located in said out-of-play receptacle;

transfer means associated with said out-of-play receptacle and said launcher means, said transfer means capable of being manipulated so as to cause the transfer of said movable member from said out-of-play receptacle to said launcher means;

user operable means for impinging a jet of fluid so as to operate said transfer means in order to manipulate said transfer means to cause the transfer of said movable member from said out-of-play receptacle to said launcher means.

2. A game having a transparent housing, a liquid located within said housing, a movable member having a specific gravity greater than the specific gravity of said liquid, said movable member located within said housing in said liquid, two circulating means for circulating said liquid within said housing, each of said circulating means capable of being independently operated such that each is capable of removing liquid from the interior of said housing and ejecting a stream of said liquid into the interior of said housing at a variable rate, each of said circulating means having a nozzle directed into the interior of said housing for ejecting said stream of liquid into the interior of said housing the improvement which comprises:

said nozzles located seperately within the interior of said housing and spaced apart from one another such that said stream of liquid ejected from each of said nozzles will at least each initially move independently from the stream of liquid ejected from the other of said nozzles;

two pivoting members each independently pivotally mounted within the interior of said housing in said liquid and each capable of moving with respect to said housing, one of said pivoting members operatively associated with the nozzle of one of said circulating means and the other of said pivoting members operatively associated with the nozzle of the other of said circulating means, each of said pivoting members independently being capable of being pivoted with respect to said housing in response to impingement upon at least a portion of each of said pivoting members by a portion of said stream of liquid ejected from its associated nozzle;

a portion of said stream of liquid ejected from each of said nozzles capable of moving past the pivoting member associated with said nozzles from which said stream of liquid is ejected without impinging upon said pivoting member to cause currents to flow within the body of liquid located within said housing;

each of said pivoting members capable of independently causing movement of said movable member within said housing when said movable member is positioned adjacent to said pivoting member such that it can be contacted by said pivoting member as said pivoting member pivots;

goal receptacle means located within said housing and surrounded by said liquid so as to be capable of receiving said movable member as said movable member moves through said liquid;

said goal receptacle means comprises a goal receptacle having an inlet opening and an outlet opening and including a closure means associated with said outlet opening to reversibly close said outlet opening allowing retention of said movable member within said goal receptacle and release of said movable member from said goal receptacle through said outlet opening by disassociating said closure means from said outlet opening;

said housing is vertically oriented and includes said pivoting members located below said goal receptacle and said outlet opening of said goal receptacle located below said inlet opening of said goal receptacle;

movable member launcher means located within said housing, at least a portion of said launcher means is located within said liquid;

said movable member launcher means capable of causing said movable member to move within said liquid such that it is capable of being acted upon by said pivoting members;

at least one out-of-play receptacle located in association with the lower extremities of said vertically oriented housing, said movable member capable of being located within said out-of-play receptacle and incapable of being acted upon by said pivoting members when located in said out-of-play receptacle;

transfer means associated with said out-of-play receptacle and said launcher means, said transfer means capable of transferring said movable member from said out-of-play receptacle to said launcher means;

said transfer means includes a member pivotally mounted at a point between its two ends to said housing, said member forming the bottom surface of said out-of-play receptacle and capable of retaining said movable member within said out-of-play receptacle when the first of its ends is at a lower vertical orientation than the second of its ends and capable of transferring said movable member to said launcher means when the first of its ends is at a higher vertical orientation than the second of its ends.

3. A game having a transparent housing, a liquid located within said housing, a movable member having a specific gravity greater than the specific gravity of said liquid, said movable member located within said housing in said liquid, two circulating means for circulating said liquid within said housing, each of said circulating means capable of being independently operated such that each is capable of removing liquid from the interior of said housing and ejecting a stream of said liquid into the interior of said housing at a variable rate, each of said circulating means having a nozzle directed into the interior of said housing for ejecting said stream of liquid into the interior of said housing the improvement which comprises:

said nozzles located separately within the interior of said housing and spaced apart from one another such that said stream of liquid ejected from each of said nozzles will at least each initially move independently from the stream of liquid ejected from the other of said nozzles;

two pivoting members each independently pivotally mounted within the interior of said housing in said liquid and each capable of moving with respect to said housing, one of said pivoting members operatively associated with the nozzle of one of said circulating means and the other of said pivoting members operatively associated with the nozzle of the other of said circulating means, each of said pivoting members independently being capable of being pivoted with respect to said housing in response to impingement upon at least a portion of each of said pivoting members by a portion of said stream of liquid ejected from its associated nozzle;

a portion of said stream of liquid ejected from each of said nozzles capable of moving past the pivoting member associated with said nozzles from which said stream of liquid is ejected without impinging upon said pivoting member to cause currents to flow within the body of liquid located within said housing;

each of said pivoting members capable of independently causing movement of said movable member within said housing when said movable member is positioned adjacent to said pivoting member such that it can be contacted by said pivoting member as said pivoting member pivots;

goal receptacle means located within said housing and surrounded by said liquid so as to be capable of receiving said movable member as said movable member moves through said liquid;

said housing is vertically oriented and includes said pivoting members located below said goal receptacle and said outlet opening of said goal receptacle located below said inlet opening of said goal receptacle;

movable member launcher means located within said housing, at least a portion of said launcher means is located within said liquid;

said movable member launcher means capable of causing said movable member to move within said liquid such that it is capable of being acted upon by said pivoting members;

at least one out-of-play receptacle located in association with the lower extremities of said vertically oriented housing, said movable member capable of being located within said out-of-play receptacle and incapable of being acted upon by said pivoting members when located in said out-of-play receptacle;

transfer means associated with said out-of-play receptacle and said launcher means, said transfer means capable of transferring said movable member from said out-of-play receptacle to said launcher means;

said transfer means includes a member pivotally mounted at a point between its two ends to said housing, said member forming the bottom surface of said out-of-play receptacle and capable of retaining said movable member within said out-of-play receptacle when the first of its ends is at a lower vertical orientation than the second of its ends and capable of transferring said movable member to said launcher means when the first of its ends is at a higher vertical orientation than the second of its ends.

* * * * *